United States Patent [19]

Leeds

[11] Patent Number: 4,931,033

[45] Date of Patent: Jun. 5, 1990

[54] PLASTIC BAG CONSTRUCTION

[75] Inventor: Dennis Leeds, Edgewood, Ky.

[73] Assignee: Equitable Bag Co., Inc., Astoria, N.Y.

[21] Appl. No.: 305,295

[22] Filed: Feb. 1, 1989

[51] Int. Cl.[5] ..... B31B 1/64; B31B 49/04; B31B 1/18; B65D 33/08

[52] U.S. Cl. ..... 493/195; 383/10; 383/35; 383/908; 493/194; 493/926

[58] Field of Search ..... 383/10, 35; 493/194, 493/195, 926

[56] References Cited

U.S. PATENT DOCUMENTS

| | | | |
|---|---|---|---|
| 2,695,646 | 11/1954 | Van Wyk | 383/35 |
| 3,023,947 | 3/1962 | McDuffie | 383/35 |
| 3,240,420 | 3/1966 | Membrino | 383/10 |
| 3,276,672 | 10/1966 | Heimos | 383/35 |
| 3,497,130 | 2/1970 | Stahl | 383/10 |
| 4,036,116 | 7/1977 | Tetenborg et al. | 383/10 |
| 4,216,899 | 8/1980 | Kamp | 383/10 |

FOREIGN PATENT DOCUMENTS

| | | | |
|---|---|---|---|
| 1103214 | 6/1981 | Canada | 383/10 |
| 1486729 | 7/1970 | Fed. Rep. of Germany | 383/10 |
| 2622659 | 12/1977 | Fed. Rep. of Germany | 383/10 |
| 0183216 | 6/1935 | Switzerland | 383/35 |
| 1054510 | 1/1967 | United Kingdom | 383/10 |
| 1150368 | 4/1969 | United Kingdom | 383/10 |
| 1315262 | 5/1971 | United Kingdom | 493/926 |
| 1273157 | 5/1972 | United Kingdom | 383/10 |
| 1280224 | 7/1972 | United Kingdom | 383/10 |
| 1529196 | 10/1978 | United Kingdom | 383/10 |

*Primary Examiner*—Stephen P. Garbe
*Attorney, Agent, or Firm*—Brumbaugh, Graves, Donohue & Raymond

[57] ABSTRACT

A method of making plastic bags in an in-line production stream having hand holes reinforced by double ply plastic material in which the molecular orientation of the plastic material extends across the bags and generally parallel to the upper ends of the bags. The method includes forming a longitudinal gusset along the upper ends of the bags in the machine direction of the plastic extrusion, slitting the inner fold line of the gusset, sealing the inner slit ends longitudinally to the adjacent front and back walls of the bags, forming transverse seals to close the side edges of the bags and separating the bags along the transverse seals.

2 Claims, 4 Drawing Sheets

PLASTIC BAG CONSTRUCTION

This invention relates to a novel method of making in an in-line production stream plastic carry out bags having hand holes reinforced by double ply plastic film in which the molecular orientation of the double ply reinforcing plastic material extends across the bags and generally parallel to the upper ends thereof.

The invention also relates to a plastic carry out bag made by said method.

BACKGROUND OF THE INVENTION

Plastic bags are widely used by markets and department stores for packaging items purchased by shoppers. To hold down the cost, these shopping bags are generally made of thin film plastic material of suitable mechanical strength having aligned hand holes in the upper regions of the front and rear panels of the bag. The vulnerability of the hand holes to tearing limits the load that the bag can carry.

The hand holes of plastic shopping bags have been reinforced by patches and double ply material, but this adds appreciably to the cost of the bags because it has not been possible to produce such bags in an in-line production stream.

SUMMARY OF THE INVENTION

In the in-line production of plastic shopping bags, the shopping bags are generally made from an extruded tube of the plastic material with the lengths of the bags extending longitudinally in the machine direction and the upper ends of the bags extending transversely of the machine direction. Since the molecular orientation of the plastic material extends longitudinally in the machine direction, the hand holes are weak and easily torn and require reinforcement which cannot be achieved in conventional methods of in-line production of bags.

In the novel in-line production of plastic bags according to the present invention, the bags are made with the lengths of the bags extending transversely to the machine direction and the upper ends of the bags extending in the machine direction. In this way, the hand holes in the bags will be stronger and less likely to tear because the molecular orientation of the plastic material will extend across the bag generally parallel to the upper ends of the bags.

In addition, the hand holes are reinforced in the bags by a double ply reinforcement produced in the in-line production stream by forming a gusset in the upper ends of the bags, slitting the inner fold line of the gusset to form foldback reinforcement panels between the front and rear walls of the bags and sealing each foldback reinforcement panel to the adjacent wall of the bag. The hand holes are then punched through the reinforced upper ends of the bags, transverse seals are made in the tube to form the side edges of the bags and the tube is cut along the transverse seals to separate the individual bags.

The bags thus produced in an in-line production stream have hand holes reinforced by double ply plastic material with the molecular orientation of the double ply material extending across the bag and generally parallel to the upper ends of the bags.

As a further feature of the present invention, the bags can be provided with offset upper ends in the in-line process to facilitate opening the bags by forming the inner fold line of the gusset off-center between the fold lines which define the upper ends of the bags.

DESCRIPTION OF THE DRAWINGS

For a more complete understanding of the invention, reference can be made to the detailed description which follows and to the accompanying drawings in which.

DETAILED DESCRIPTION OF THE INVENTION

In the method of making plastic bags in an in-line production stream, the plastic material is extruded in the form of a large tube which is flattened and fed longitudinally in the machine direction by rollers. The plastic material and the gauge thereof is selected to provide the mechanical strength desired. Low density polyethylene or a blend of the high and low density polyethylene are often used on the manufacture of shopping bags.

Figure 1:
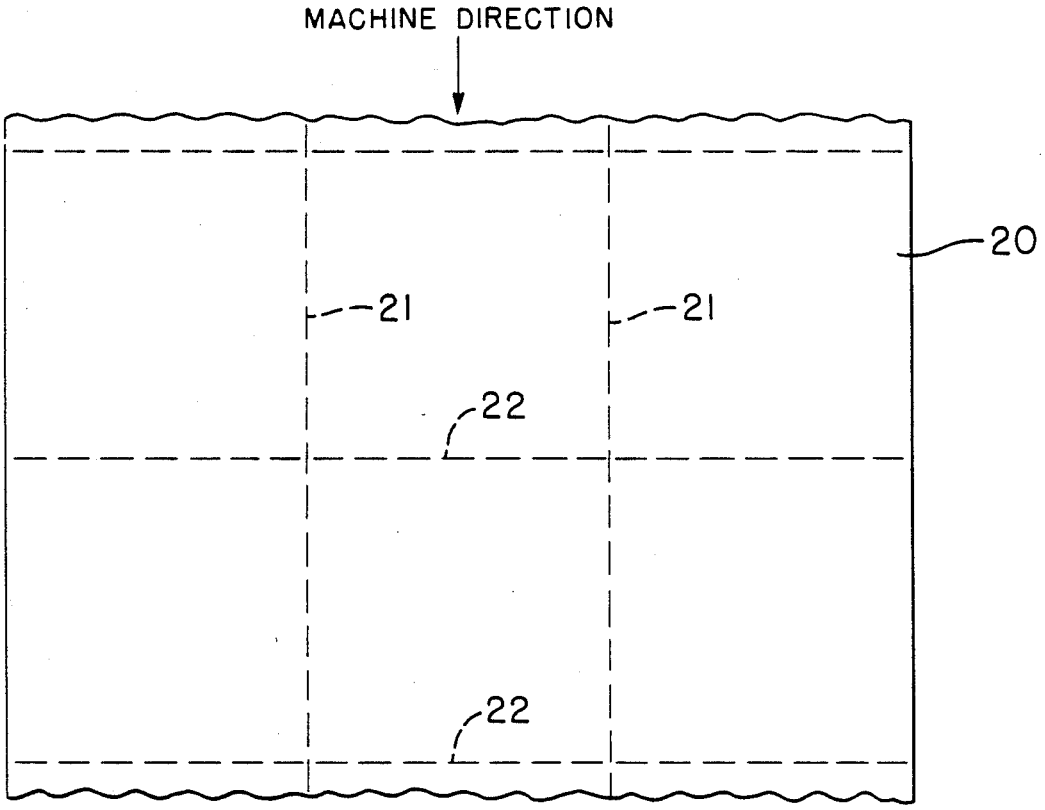
FIG. 1 is a front view of an extruded flat tube of the plastic material from which the bags are made in an in-line production stream with the outlines of the bags indicated in broken lines.

A large flattened tube 20 is shown in FIG. 1 with machine direction indicated by the arrow and the layout of the bags indicated by broken longitudinal lines 21 and broken transverse lines 22. Because the molecular orientation of the plastic material extends in the machine direction, the lengths of the bags are arranged to extend transversely to the machine direction and the upper ends of the bags are arranged to extend longitudinally in the machine direction.

Figure 2:
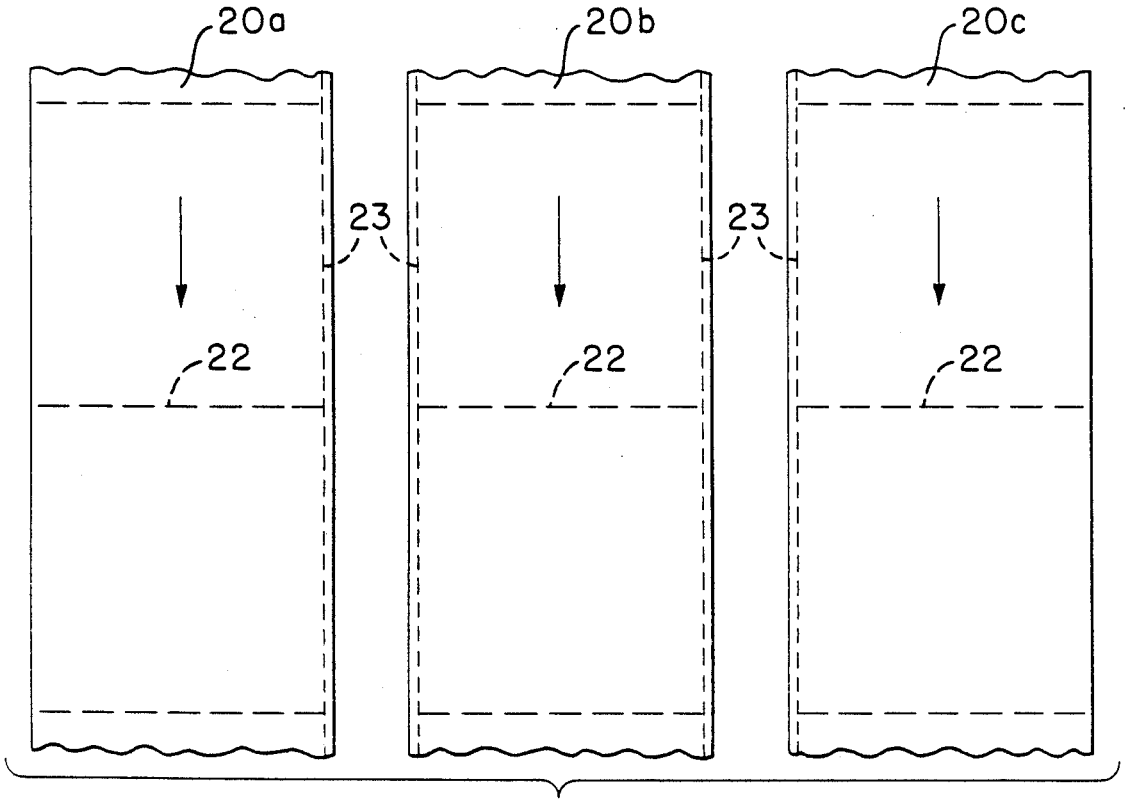
FIG. 2 shows the tube subdivided and longitudinally sealed to define three flat tubes.

The wide tube 20 is subdivided into three tubes 20*a*, 20*b* and 20*c*, as shown in FIG. 2, by forming longitudinal seals 23 along the longitudinal lines 21 and then separating the tubes 20*a*, 20*b* and 20*c* by cutting along the longitudinal seals. Since bags are made from each of the subdivided tubes, the further steps of the method will be described with respect to the subdivided tube 20*a*.

Figure 6:
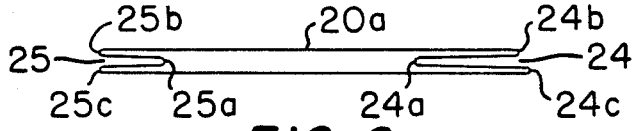
FIG. 6 is a sectional view of the flattened gusseted tube taken along the line 6—6 of FIG. 3.

As shown in FIG. 6, a longitudinal gusset 24 is formed in the portion of the elongated tube 20*a* that corresponds to the upper ends of the bags. If desired, a longitudinal gusset 25 can also be formed in the portion of the elongated tube that corresponds to bottoms of the bags. The gusset forming steps are shown in FIGS. 3 to 5.

Figure 4:
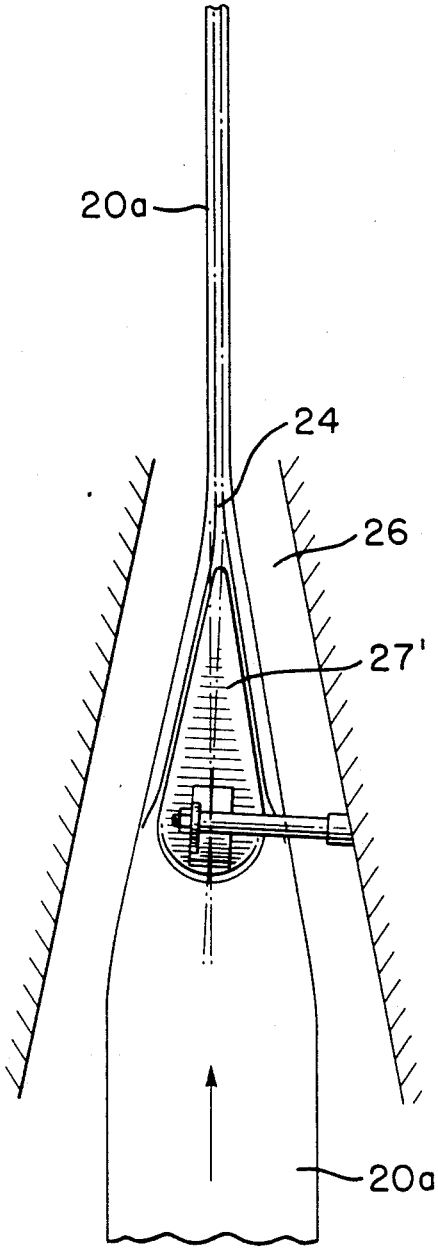
FIG. 4 is a side view of the tube shown in FIG. 3 showing the gusset formed in the tops of the bags.
Figure 3:
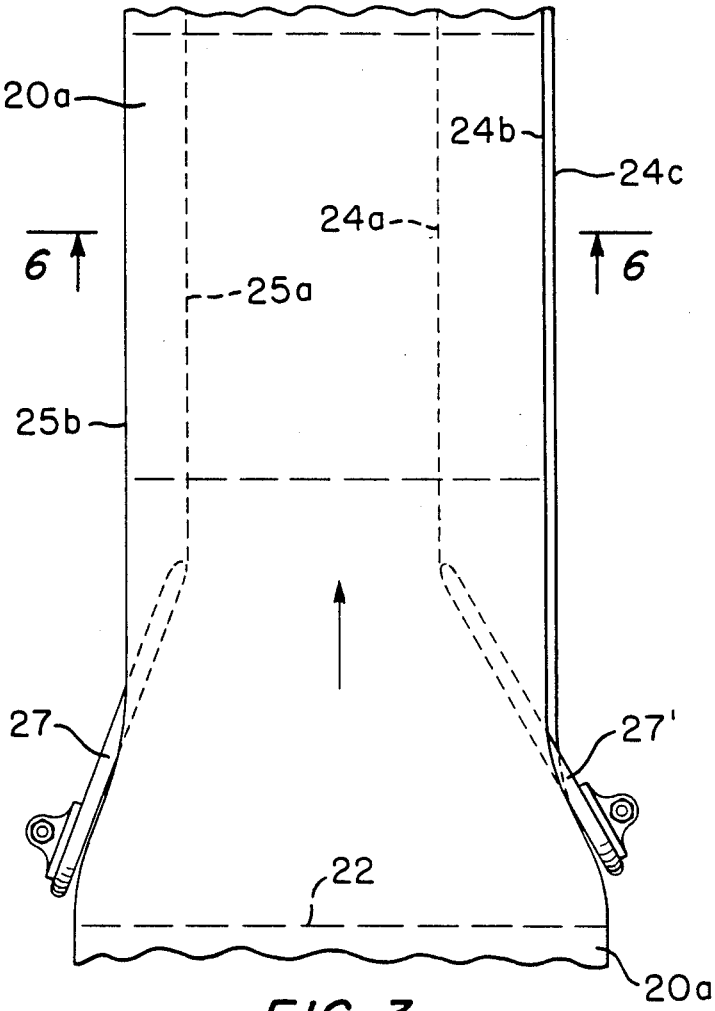
FIG. 3 is a front view of one of the partially inflated tubes having longitudinal gussets formed in the tops and bottoms of the bags.
Figure 5:
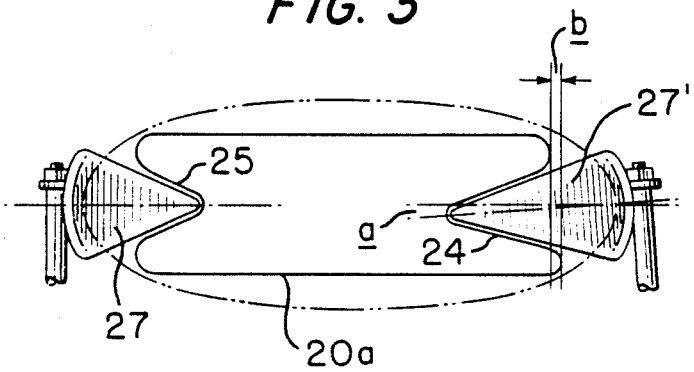
FIG. 5 is a sectional view showing the gusset formed in the partially inflated tube.

As shown is FIGS. 3 to 5, the tube 20*a* is partially inflated before passing through an A-frame 27 to which a pair of gusset boards 27, 27[1] are mounted. The gusset boards 27, 27[1] are oppositely inclined with tapered ends extending downstream of the machine direction of the tube 20*a*. The gusset board 27 which forms the bottom gusset 25 for the bags is oriented to center the inner fold line 25*a* between the outer fold lines 25*b* and 25*c* which define the bottom ends of the bags. On the other hand, the gusset board 27[1] which forms the gusset 24 is oriented at an angle a to locate the inner fold line 24*a* off-center of the outer fold lines 25*b* and 25*c* to offset the outer fold lines by the distance b shown in FIG. 5. In this manner the fold line 24*b* which forms the upper ends of the front walls of the bags will be offset lower than the fold line 24*c* which forms the upper ends of the rear walls of the bags to facilitate opening the bags.

Figure 7:
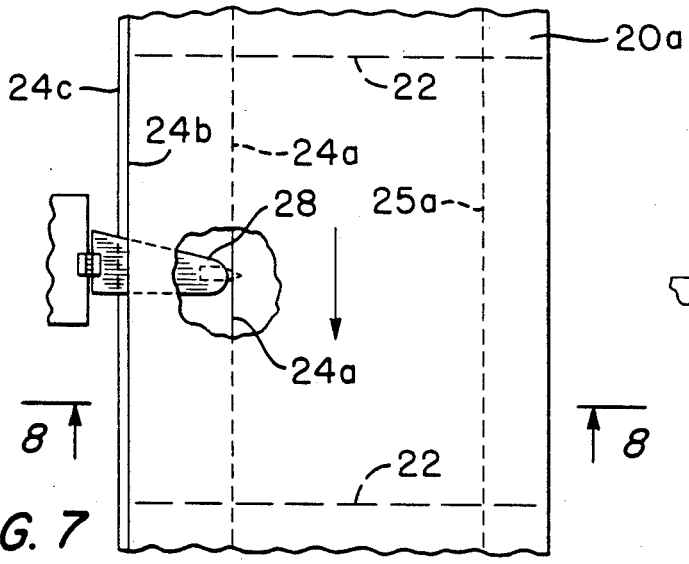
FIG. 7 is a front view of the tube showing the slitting of the gusset formed in the tops of the bags.
Figure 8:
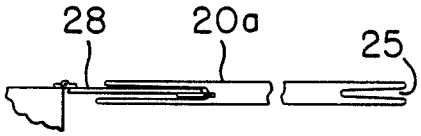
FIG. 8 is a sectional view taken along the line 8—8 of FIG. 7.
Figure 9:
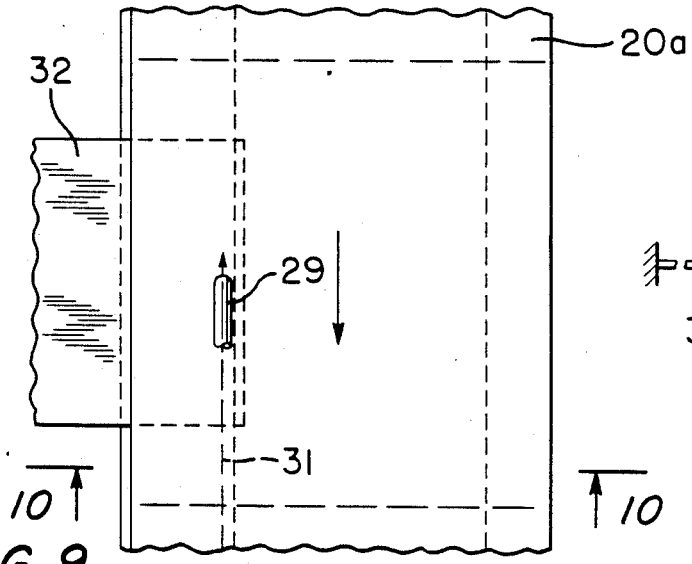
FIG. 9 is a front view of the tube showing the foldback panels of the slit gusset being longitudinally sealed to the adjacent front and back walls of the bags.
Figure 10:
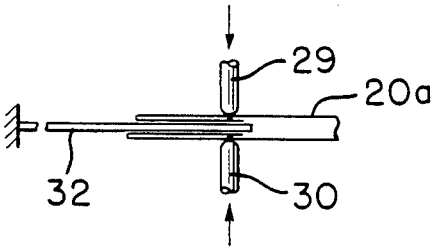
FIG. 10 is a sectional view taken along the line 10—10 of FIG. 9.

To open the bags the gusseted tube 20*a* is advanced relative to a stationary slitter 28, shown in FIGS. 7 and 8, which slits the inner fold line 24*a* of the gusset 24.

The slit inner ends of the folded back panels of the gusset 24 are now sealed longitudinally to the adjacent front and rear walls of the bags to reinforce the upper regions of the bags. Toward this end, the slit tube 20*a* is advanced between a pair of conduits 29, 30 which direct hot air discharges against the front and back walls of the bags to form longitudinal seals 31 to seal the inner longitudinal slit ends of the reinforcing foldback panels to the respective adjacent walls of the bags. A cold metal plate 32 interposed between the foldback panels prevents the panels from being sealed together. The longitudinal seals 31 can be continuous or in the form of a pattern, such as a plurality of spaced apart, discrete seals.

Figure 11:
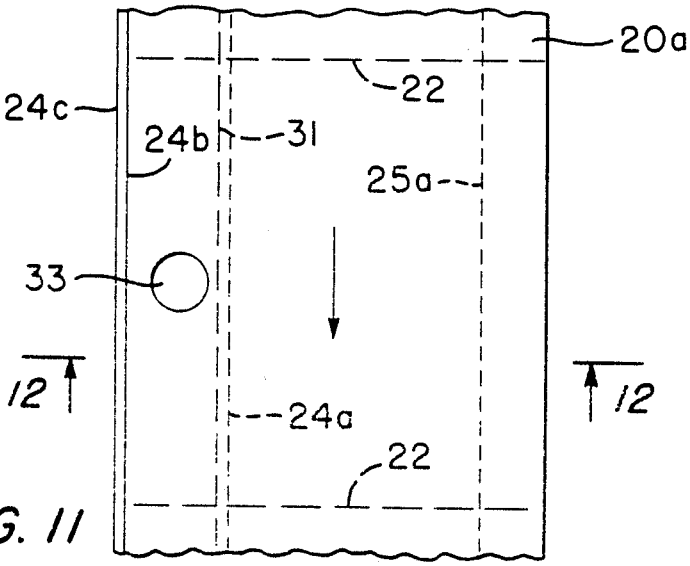
FIG. 11 is a front view of the tube showing the hand holes punched through the upper reinforced regions of the bags.
Figure 12:
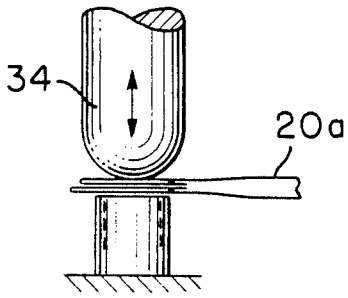
FIG. 12 is a sectional view taken along the line 12—12 of FIG. 11.

Hand holes 33 are punched in the reinforced upper ends of the bags, as shown in FIGS. 11 and 12, by a punch 34 which produces clean, circular, aligned holes of between 1 ½ and 2½ inches in diameter in the reinforced front and back walls of the bags. Instead of punching aligned holes in the reinforced front and back walls of the bags, the holes in the front and back walls can be separately punched to offset them slightly in the vertical or lengthwise direction to facilitate grasping and opening the bags when they are supported from a hook.

Figure 13:
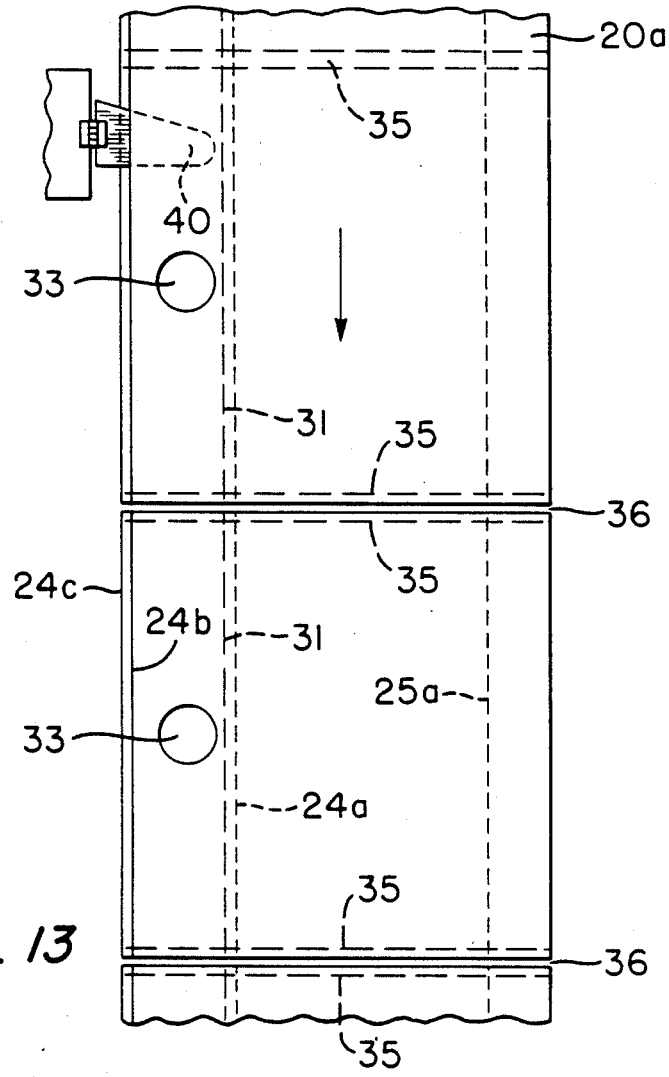
FIG. 13 is a front view of the tube showing the steps of forming transverse seals to define the side edges of the bags and the separation of the bags along the transverse seals.
Figure 14:
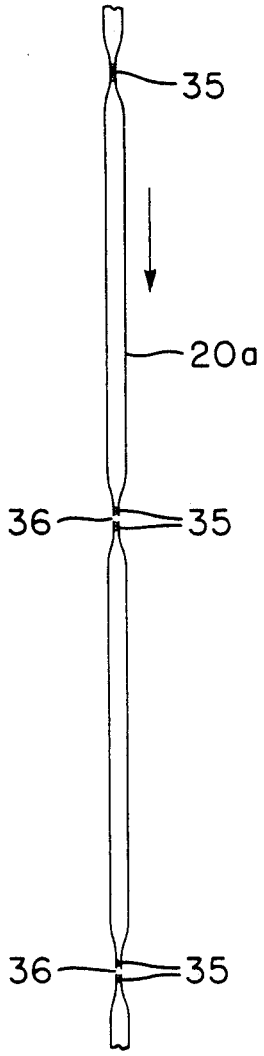
FIG. 14 is a side view of FIG. 13.

As shown in FIGS. 13 and 14, transverse seals 35 are made across the slit tube 20*a* to close the side edges of the bags, and the bags are cut at 36 along the transverse seals to separate the bags.

In punching aligned hand holes 33, the reinforced panels may tend to adhere around the outer perimeters of the hand holes. To insure separation of the reinforced panels, the gusseted tube 20*a* is advanced relative to a stationary plate 40 downstream of the punch 34. The separating plate 40 insures separation of the reinforced panels so that the bags will open at the top.

Figure 15:
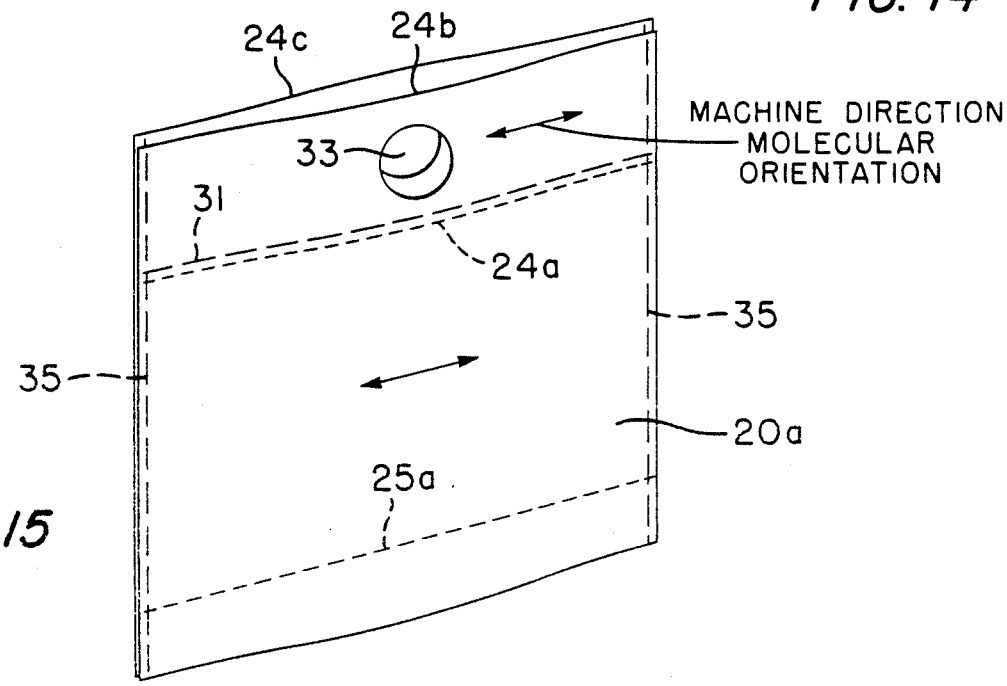
FIG. 15 is a perspective view of the bag having reinforced hand holes.

The finished bag, shown in FIG. 15, is made in an in-line production stream and has hand holes 33 reinforced by double ply plastic film in which the molecular orientation of the reinforced double ply material extends across the bag and parallel to the upper end of the bag with the upper edges 24*b* and 24*c* offset to facilitate opening the bag.

The invention has been shown and described in a single, preferred embodiment, and many variations and modifications are possible within the scope of the appended claims.

I claim:

1. A method of making plastic bags in line having reinforced hand holes comprising forming an elongated tube of plastic material with the molecular orientation of the plastic material extending in the longitudinal direction of the tube, forming a longitudinal gusset in the tube to define the upper ends of the bags, said gusset including a pair of foldback reinforcement panels defined between a pair of outer longitudinal fold lines which form the upper ends of the bags and an inner longitudinal fold line which connects inner ends of the foldback reinforcement panels, slitting the inner fold line to open the bags, flattening the tube to form front and back walls of the bags, sealing the longitudinal inner end of each foldback panel to the adjacent wall, while separating the foldback panels to prevent them from being sealed together, punching hand holes in the reinforced upper ends of the bags, forming transverse seals in the longitudinal webs to form side edges of the bags and separating the bags along the transverse seals, the bags having hand holes formed in the reinforced upper ends of the bags in which the molecular orientation of the plastic material extends parallel to the upper ends of the bags.

2. A method as set forth in claim 1 in which the separation of the foldback panels is achieved by interposing a cold metal plate between the foldback panels to prevent the panels from being sealed together.

* * * * *